United States Patent [19]

Cone

[11] Patent Number: 4,658,975

[45] Date of Patent: Apr. 21, 1987

[54] LIQUID CONTAINER WITH HANDLE

[76] Inventor: Robert L. Cone, Yoder Rd., R.D. #2, Elverson, Pa. 19520

[21] Appl. No.: 771,084

[22] Filed: Aug. 30, 1985

[51] Int. Cl.[4] ..... B65D 1/02; B65D 1/04; B65D 23/10; B65D 25/30

[52] U.S. Cl. ..... 215/100 A; 220/94 A; 222/465.1; 294/26.5

[58] Field of Search ..... 215/100 A, 100 R; 220/94 A, 855 P, 94 R; D9/374, 376, 378, 382, 383; 294/26.5; 222/465 R, 465 A

[56] References Cited

U.S. PATENT DOCUMENTS

| | | | |
|---|---|---|---|
| D. 194,486 | 1/1963 | Hill | D9/374 |
| D. 213,821 | 4/1969 | Platte | D9/40 |
| D. 238,654 | 2/1976 | Platte | D9/40 |
| D. 265,797 | 8/1982 | Platte | D9/378 |
| D. 271,113 | 10/1983 | Birkeland et al. | D9/376 X |
| D. 274,307 | 6/1984 | Ledda | D9/376 X |
| D. 274,698 | 7/1984 | Epperson | D9/376 X |
| 2,512,105 | 6/1950 | Kooij | 220/94 A X |
| 3,171,559 | 3/1965 | Ferree | 215/1 C |
| 3,443,710 | 5/1969 | Hills | 215/1 C |

FOREIGN PATENT DOCUMENTS

| | | | |
|---|---|---|---|
| 2528389 | 12/1983 | France | 215/1 C |

*Primary Examiner*—William Price
*Assistant Examiner*—Sue A. Weaver
*Attorney, Agent, or Firm*—Seidel, Gonda, Goldhammer & Abbott

[57] ABSTRACT

A liquid container provided with a passage within which the user's wrist and arm may be inserted to grip a post for purposes of pouring the contents of the container. The post is disposed within the passage, preferably on the spout side of the container center line.

8 Claims, 6 Drawing Figures

LIQUID CONTAINER WITH HANDLE

BACKGROUND OF THE INVENTION

The present invention is directed to a liquid container having separate carrying and pouring handles. The pouring handle is in the form of a post disposed within a passage having at least one end in open communication with the container exterior. In U.S. Pat. No. 3,443,710, there is disclosed a liquid container having a pair of openings 38*a*, 38*b* flanking a post 42. The arrangement defines a pair of body handles which may be tightly gripped to carry the container. U.S. Pat. No. 3,171,559 discloses a container having an opening in which a card or label may be inserted. U.S. Pat. Nos. Des. 213,821, 238,654 and 265,797 disclose various designs for container side handles. French Pat. No. 2,528,389 discloses a container wherein trenches (slots) are cut into the container body. The container is made of plastic.

The problem solved by the present invention is that of providing a pouring handle located so as to maximize stability of the container and control of the orientation of the container during pouring.

BRIEF SUMMARY OF THE INVENTION

A liquid container comprising a peripheral wall forming a chamber, a passage bounded by a wall connected to the peripheral wall, a post connected to the passage wall and disposed within the passage so as to be gripped by a user, at least one end of said passage being open to the container exterior whereby the user's forearm may be inserted in the passage to reach and grip the post.

For the purpose of illustrating the invention, there are shown in the drawings forms which are presently preferred; it being understood, however, that this invention is not limited to the precise arrangements and instrumentalities shown.

DETAILED DESCRIPTION OF THE INVENTION

Figure 1:
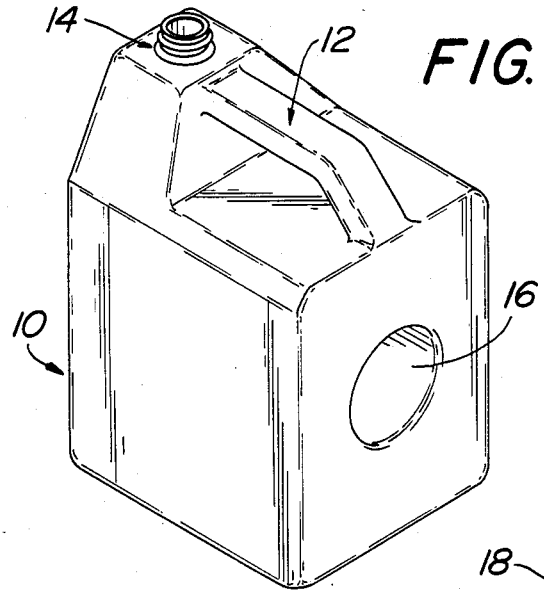
FIG. 1 is an isometric of the liquid container of the present invention.
Figure 4:
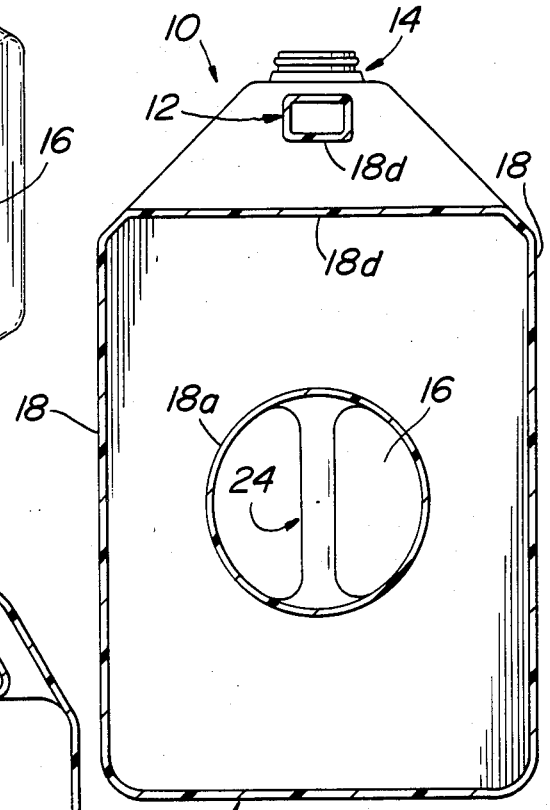
FIG. 4 is a cross-section taken along 4—4 in FIG. 3.
Figure 3:
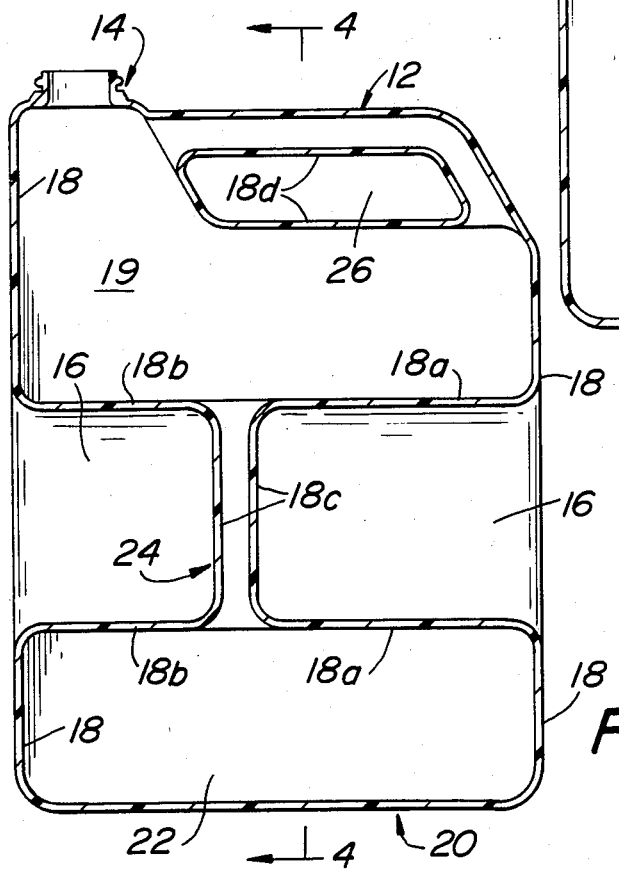
FIG. 3 is a cross-section taken along 3—3 in FIG. 2.
Figure 2:
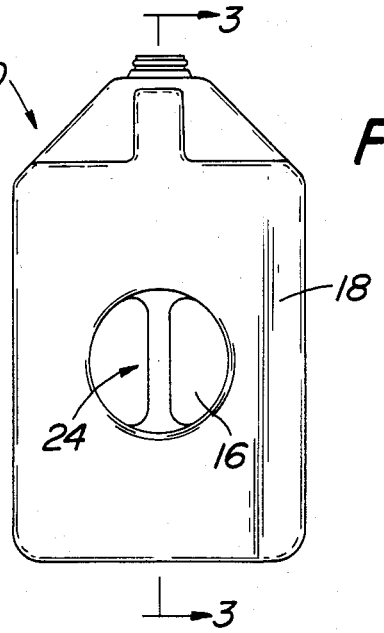
FIG. 2 is a side elevation of the liquid container.
Figure 5:
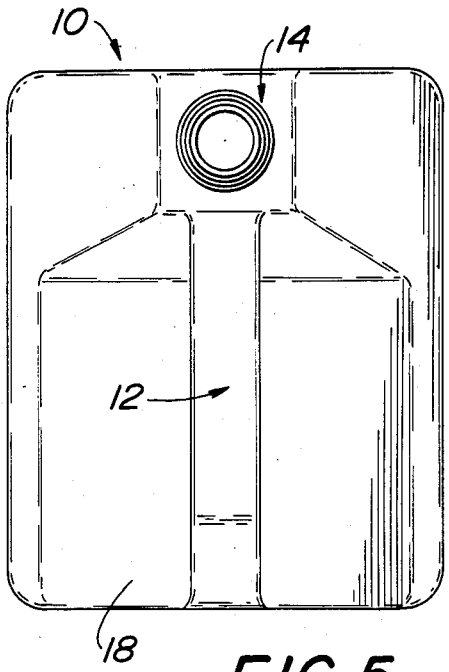
FIG. 5 is a top plan of the liquid container.

Referring to the drawings, wherein like numerals indicate like elements, there is shown in FIG. 1 an isometric of the liquid container of the present invention designated generally as 10. The container is made of a suitable polymeric plastic material and includes a carrying handle 12, spout 14 and a walled passage 16. Spout 14 may be threaded as shown in FIG. 2 so as to receive a sealing cap (not shown). The container is preferably blow molded and made of a polyethylene material. The container shape is defined by a continuous peripheral wall 18 which also defines the carrying handle 12 proximal spout 14. The peripheral wall is rigid or semi-rigid so as to retain the shape as shown in the drawings. A variety of liquids may be held by the container, including gasoline, kerosene, detergent, oil, water, liquid foodstuff, etc. As shown in FIGS. 3 and 4, the peripheral wall 18 extends between the zone of the carrying handle 12 and passage 16 so as to define a top chamber 19. The peripheral wall is flattened at the bottom of the container so as to define a base 20 which allows the container to be placed on a flat surface such as a storage shelf or the like. Between the base 20 and passage 16, the peripheral wall defines a second or bottom chamber 22. Chambers 19 and 22 are in fluid communication.

The passage 16 is bounded by a portion of the peripheral wall, designated 18*a*, extending from the location of a post 24 to the container exterior. The post 24 is preferably offset laerally from the vertical center line of the container, towards the spout side of the container, to facilitate pouring when the container is tilted as described more fully hereafter. The passage 16 is also bounded by a portion of the peripheral wall, designated 18*b*, extending between post 24 and the container exterior. The post 24 is itself defined by a portion of the peripheral wall, designated 18*c*. As shown in FIG. 3, the post is integrally connected to passage walls 18*a*, 18*b*. As shown in FIG. 4, the post intersects the vertical center line of passage 16 to allow sufficient space around the post so that it can be gripped for purposes of supporting and tilting the container during pouring as described hereafter. The handle 12 and slot 26 are also formed by a portion of the peripheral wall, designated 18*d*.

In use, the container is removed from a storage shelf or the like by grasping the carrying handle 12. To pour liquid from the container, handle 12 is gripped by one of the user's hands and post 24 is gripped by the user's other hand. The user's forearm is inserted in passage 16, from right to left in FIG. 3, so that post 24 may be gripped by the user. Wall 18*a* may be provided with a slight conical taper if desired, the taper decreasing from the container exterior towards post 24 to further facilitate insertion of the user's forearm. Post 24 is sized (outer diameter) and positioned in passage 16 so as to facilitate a sure grip by the user. Since the post is nearer to the center of gravity of the filled container than is handle 12, it is easier to discharge liquid via spout 14 by gripping post 24 to tilt the container than by merely holding the carrying handle 12 alone to tilt the container. The passage wall 18*a* may contact the user's forearm so as to "lock" the user's forearm in passage 16 and provide greater stability during pouring. Since the container is gripped at post 24 as well as handle 12, any rotational movement or "wobble" of the container during pouring is prevented.

Figure 6:
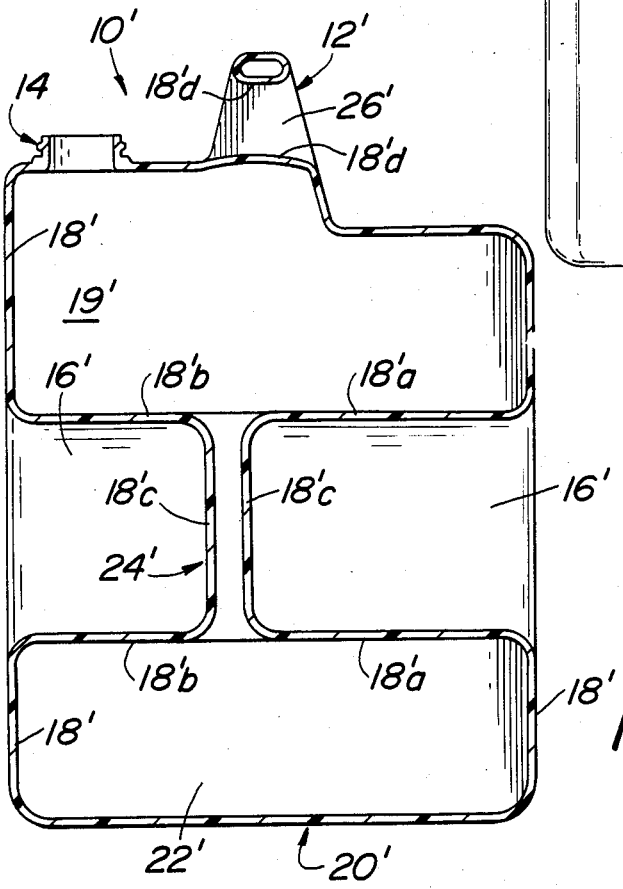
FIG. 6 is a cross-section of an alternate embodiment wherein the carrying handle extends in a direction substantially perpendicular to the longitudinal axis of the passage for the user's forearm.

An alternate embodiment 10' of the invention is shown in FIG. 6 wherein the handle 12' is formed so as to extend in a direction generally perpendicular to the axis of passage 16, the construction of the container being otherwise virtually identical to that shown in FIGS. 1–5.

Although embodiments of the invention have been described wherein the peripheral wall 18 is formed by blowmolded polyethylene, it should be appreciated that other materials are also suitable for use. For example, other plastics, glass or metallic materials may be employed. The particular material is not limiting. In addition, although a continuous peripheral wall is desirable, the container may also be constructed in parts and assembled by suitable bonding techniques. The dimensions of the container may be varied as desired to increase or reduce the liquid capacity of the container.

The present invention may be embodied in other specific forms without departing from the spirit or essential attributes thereof and, accordingly, reference should be made to the appended claims, rather than to the foregoing specification, as indicating the scope of the invention.

I claim:

1. Liquid container comprising:

a peripheral wall forming a hollow body, a passage formed in said body and bounded by a portion of said peripheral wall, a pouring handle comprising a post disposed within the passage so as to be gripped by a user, at least one end of said passage being open to the container exterior, and said passage being of a cross-sectional dimension and length as measured between said open end of said passage at said container exterior and said post to permit contact between the portion of said peripheral wall bounding said passage and the user's forearm upon gripping of said post by the user whereby said container is supportable by one arm both at said post and at a portion of said peripheral wall bounding said passage.

2. Liquid container, comprising:

a peripheral wall defining a hollow top body portion and a hollow bottom body portion, the hollow bottom body portion including a base, a passage intermediate the top and bottom body portions and bounded by a portion of the peripheral wall defining the top and bottom body portions, a pouring handle comprising a post connected to the top and bottom body portions and disposed within the passage so as to be gripped by the user, at least one end of said passage being open to the container exterior, and said passage being of a cross-sectional dimension and length as measured between said open end of said passage at said container exterior and said post to permit contact between the portion of said peripheral wall bounding said passage and the user's forearm upon gripping of said post by the user whereby said container is supportable by one arm both at said post and at a portion of said peripheral wall bounding said passage.

3. Liquid container, comprising:

a peripheral wall forming a chamber, a passage bounded by a wall connected to the peripheral wall, a pouring handle comprising a post connected to the passage wall and disposed within the passage so as to be gripped by a user, at least one end of said passage being open to the container exterior, and said passage being of a cross-sectional dimension and length as measured between said open end of said passage at said container exterior and said post to permit contact between the portion of said peripheral wall bounding said passage and the user's forearm upon gripping of said post by the user whereby said container is supportable by one arm both at said post and at a portion of said peripheral wall bounding said passage.

4. Liquid container according to claims 1, 2 or 3 wherein said passage is tapered to accommodate the user's forearm.

5. Liquid container according to claims 1, 2 or 3 wherein said post is laterally offset from the vertical center line of the container.

6. Liquid container according to claims 1, 2 or 3 including a carrying handle connected to said peripheral wall above the elevation of said passage.

7. Liquid container according to claims 1, 2 or 3 wherein said peripheral wall is made of polyethylene.

8. Liquid container according to claims 1, 2 or 3 including a pouring spout, said post being disposed within the passage between the spout and the vertical centerline of the container.

* * * * *